340-690 $$$ SR
E196Z OR 4,097,854

United States Patent [19]
Black et al.
[11] 4,097,854
[45] Jun. 27, 1978

[54] SENSING MECHANISM FOR MINE ROOF BOLTING APPARATUS

[75] Inventors: Sigmund Black, Belle Mead; James L. Finney, Cranbury, both of N.J.

[73] Assignee: The United States of America as represented by the Secretary of the Interior, Washington, D.C.

[21] Appl. No.: 774,354

[22] Filed: Mar. 4, 1977

[51] Int. Cl.[2] ..... G08B 21/00

[52] U.S. Cl. ..... 340/282; 340/421; 299/1

[58] Field of Search ..... 340/272, 282, 421; 61/35, 45 B, 45 C; 299/1

[56] References Cited

U.S. PATENT DOCUMENTS 3,111,655 11/1963 Kotarsky et al. ..... 340/421

*Primary Examiner*—Alvin H. Waring
*Attorney, Agent, or Firm*—Thomas Zack; Donald A. Gardiner

[57] ABSTRACT

The sensing mechanism of the present invention includes a probe electrically connected to a mine roof bolting apparatus and adapted to be embedded within a mine roof to sense any shifting of the apparatus during an operative cycle. The probe is linked to a 360° rotational toggle switch mechanism which controls an alarm means. The probe is pivotably mounted within the roof bolting apparatus and consequently, any effective movement of the apparatus along any direction within a horizontal plane pivotably displaces the probe and actuates the switch mechanism, energizing the alarm. In this manner, personnel are apprised of conditions warranting corrective measures in order to reposition the bolting apparatus or the apparatus may be automatically halted so as to prevent damage from being imparted thereto.

11 Claims, 5 Drawing Figures

SENSING MECHANISM FOR MINE ROOF BOLTING APPARATUS

BACKGROUND OF THE INVENTION

1. Field of the Invention

The present invention relates generally to mine roof bolting apparatus, and more particularly to apparatus to be utilized in conjunction with such roof bolting apparatus in order to sense or detect any translational movement thereof during an operating cycle and to indicate the same by a suitable alarm means or provide an automatic halt function.

2. Description of the Prior Art

Various devices are employed either independently of mining apparatus in order to monitor operative conditions within a mining environment, or in conjunction with such mining apparatus in order to sense or detect different parameters during operation.

For example, U.S. Pat. No. 3,817,578 discloses a conventional type sensing mechanism which is adapted to control the steering mechanism of the mine apparatus in order to maintain the thickness of a coal layer within predetermined limits. If the detected thickness is outside of the predetermined limits, then corrective measures may be imparted to the cutter head.

A pendulum type control device, for controlling a guide mechanism of a mining machine, is disclosed in U.S. Pat. No. 3,397,915, the control device seeking to maintain the guide mechanism within a predetermined plane relative to the mine floor in order to properly perform a cutting operation with respect to the mineral seam. British Patent 1,141,191 discloses the use of strain gauge apparatus for properly orientating the mineral cutting tool with respect to a mineral seam.

Another type of device, which is designed to be operative independently of mining apparatus, is disclosed in U.S. Pat. No. 3,111,655 which includes a probe mechanism secured within the roof or ceiling of the mine. The same is adapted to sense minor shifts in the mine strata and generate a signal in response thereto such that corrective measures may be taken, for example, by mine safety engineers.

Since the inception of underground mining, the need to support the overhead ceiling or roof in the underground passageways of a mine has been recognized as essential in order to prevent failure or collapse of the roof of the mine thereby jeopardizing the lives of individuals working in the underground mine. Typically, elongated roof bolts are inserted into openings drilled at predetermined spaced apart intervals. These bolts tend to secure together thin strata or bands of rock above the roof and prevent lateral shifting of the strata, as well as, in some instances, to anchor the strata to more massive overlying rock. The bolts are secured to the roof by a roof bolting apparatus which drills the openings as mentioned above, and then inserts the bolts into the openings, sometimes filling the opening around the bolt with a resin. During the bolting cycle, it is imperative that there be no shifting of the roof relative to the apparatus in order to prevent substantial damage from being imparted to the apparatus.

While the prior art includes various other sensing devices per se as well as sensing mechanisms incorporated within mining machinery for performing various types of sensing operations, there appears to be substantial need for sensing or detecting means which may be utilized in conjunction with mine roof bolting apparatus in order to sense or detect any translational movement of a bolting mechanism part of the apparatus relative to the mine roof during an operating cycle.

OBJECTS OF THE INVENTION

Accordingly, it is an object of the present invention to provide a new and improved sensing mechanism.

Another object of the present invention is to provide a new and improved sensing mechanism which is to be utilized in conjunction with mine roof bolting apparatus.

Still another object of the invention is to provide a new and improved sensing mechanism in conjunction with mine roof bolting apparatus which is able to detect and indicate a shift of such apparatus relative to the mine roof.

Yet another object of the present invention is to provide a new and improved sensing mechanism in conjunction with mine roof bolting apparatus which is able to detect and indicate a shift of such apparatus relative to the mine roof in any direction within a horizontal plane.

Another object is to provide a new and improved sensing mechanism which is able to detect and respond to a shift of such apparatus relative to the mine roof so as to prevent the occurrence of damage to such apparatus and the roof bolting mechanism thereof.

BRIEF DESCRIPTION OF THE INVENTION

The sensing mechanism of the present invention comprises a spiked probe which is adapted to be embedded in a mine roof. The probe is operatively connected with a hydraulic cylinder device mounted within the roof bolting apparatus, and in this manner, the probe may be projected outwardly from the bolting apparatus, under the influence of the hydraulic cylinder forces, so as to be embedded in the mine roof.

The probe and cylinder mechanism is pivotably mounted within the bolting apparatus and is linked by a 360° toggle switch connected to an alarm system which may be of the audible or visual type, and to a control for halting the apparatus. In this manner, any translational movement of the bolting apparatus, in any direction so as to have a force component in a horizontal plane, will serve to pivotably move the cylinder-probe assembly. The pivotable movement of the cylinder-probe assembly actuates the switch mechanism thereby energizing the control for halting the apparatus and the alarm system enabling personnel to take corrective action.

Other objects, advantages and features of the present invention will become readily apparent to those skilled in the art from the following detailed description, wherein we have shown and described, simply by way of illustration of the best modes contemplated by us of carrying out our invention. It is to be understood that the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF A PREFERRED EMBODIMENT

Figure 1:
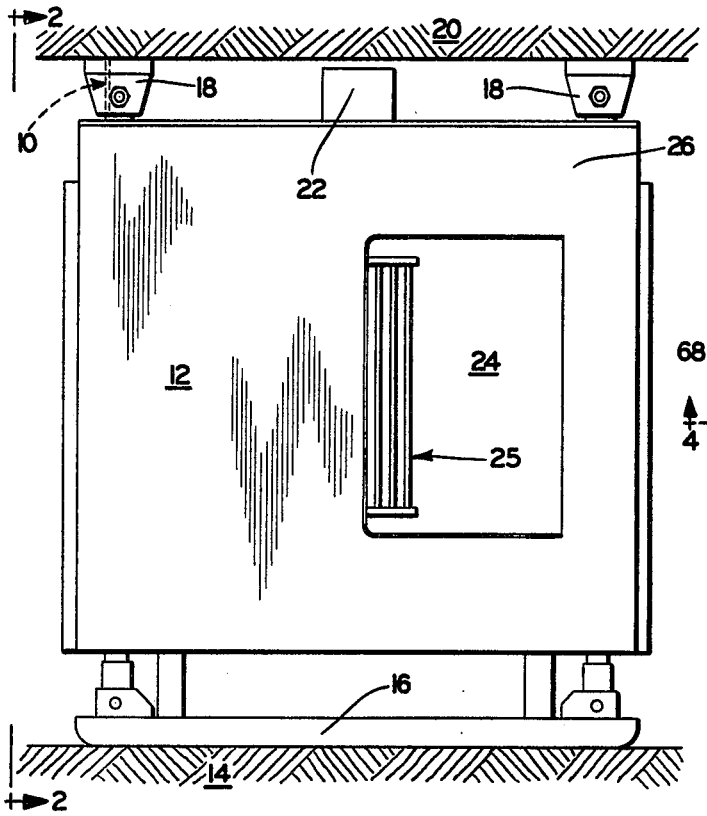
FIG. 1 is a side elevation view of a mine roof bolting apparatus having incorporated therein the sensing mechanism of the present invention.
Figure 2:
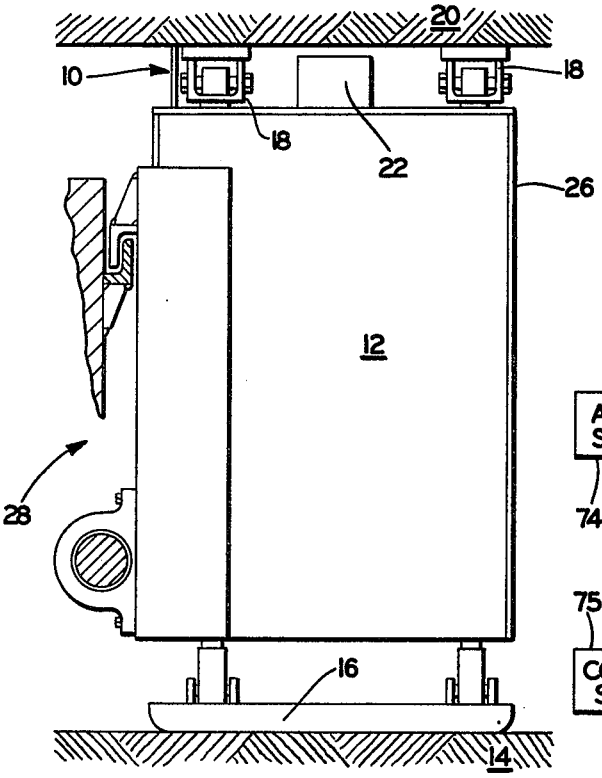
FIG. 2 is an end elevation view of the apparatus of FIG. 1 as viewed in the direction of arrows 2—2.

Referring now to the drawings, and particularly to FIG. 1 thereof, a sensing device in accordance with the present invention is generally indicated by the reference character 10 and is seen to be incorporated within a conventional mine roof bolting apparatus or frame 12. The apparatus 12 is supported on the mine floor 14 by a conventional foot pad or skid generally indicated at 16 and is likewise provided with mine roof engaging devices or jack pads 18 which operatively engage the mine roof 20. In this manner, the apparatus 12 is adequately supported with respect to the mine floor 14 and mine roof 20 so as to facilitate the performance of a mine roof bolting operation by means of a conventional mine roof bolting mechanism 22 of the bolting apparatus 12 through which bolts stored in a cartridge 25 are applied to the roof 20. An access door 24 is provided within a sidewall 26 of the apparatus 12 in order to facilitate access to the interior of the apparatus 12, particularly the bolt storage cartridge 25 thereof. A conventional draft structure generally indicated at 28 (FIG. 2) is provided in conjunction with the apparatus 12 in order to facilitate transportation of the same within the mine.

As noted hereinabove, despite the presence or provision of foot pad arrangement 16 and roof engaging devices 18 upon the bolting apparatus 12, it has been found that such apparatus nevertheless experiences some movement relative to the mine roof and consequently, in accordance with the present invention, the sensing device 10 is provided in conjunction with bolting apparatus 12 in order to indicate to mine personnel that some shift or movement of line apparatus 12 has in fact taken place relative to the mine floor or roof and to halt operations. As also noted hereinabove, if such a shift or movement does occur during the performance of the mine bolting operation by means of mechanism 22, damage to the latter and/or the apparatus 12 is likely to be experienced.

Figure 3:
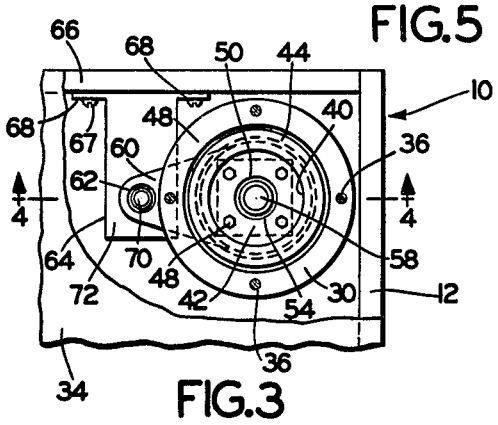
FIG. 3 is a partial plan view of the apparatus of FIG. 1.
Figure 4:
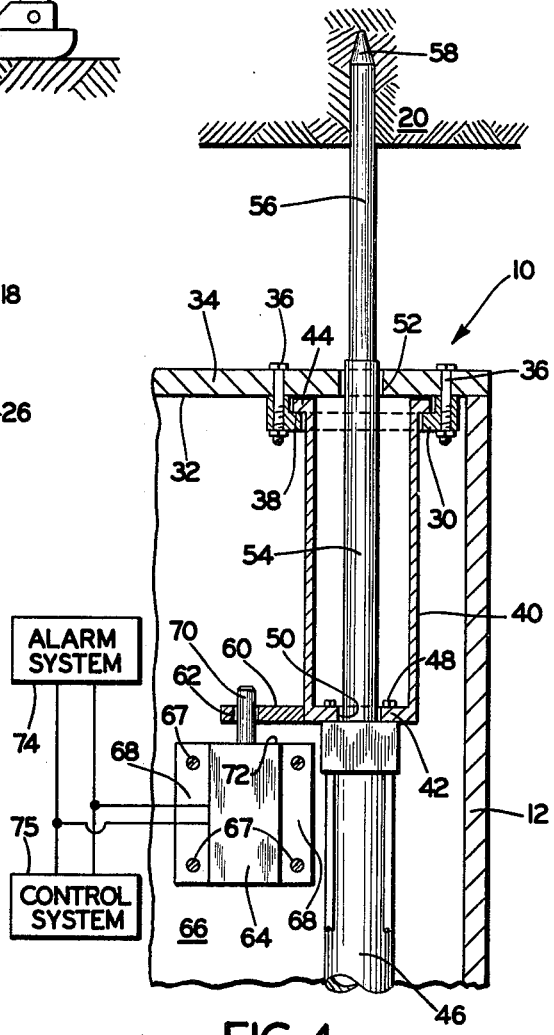
FIG. 4 is a partial, enlarged cross-sectional view of the apparatus of FIG. 3 taken along the line 3—3 thereof.

Considering then the apparatus of the present invention, it is seen from the Figures that at least one shift sensor device 10 is provided on the apparatus 12, and as disclosed, is disposed within an upper corner region thereof. As best seen from FIGS. 3 and 4, the sensor device 10 comprises an annular stepped or counterbored bracket 30 which is secured to the underside surface 32 of the top cover 34 of apparatus 12 by means of a plurality of bolt and nut assemblies 36 disposed about the periphery of the bracket. The bracket 30 is located on cover 34 such that a radially inwardly projecting shoulder 38 is spaced from the underside surface 32 of the cover 34.

A vertically extending tubular member 40, open at the upper end thereof and closed at the lower end by means of an end wall 42, is concentrically disposed with bracket 30. The upper end of member 40 is provided with a radially outwardly projecting annular flange 44 and the depth of the same is somewhat less than that of the spacing defined between shoulder 38 of bracket 30 and the underside surface 32 of cover 34. In this manner, flanged portion 44 of tubular member 40 is able to be seated on shoulder 38 whereby tubular member 40 is supported thereon in a floating manner. It is to be noted that the outer diametrical extends of tubular member 40 and the flanged portion 44 thereof are less than the inner diametrical extents, respectively, of the upper and lower sections of annular bracket 30, and as a result, the tubular structure may be easily accomodated within bracket 30.

A vertically disposed hydraulic cylinder 46 (FIG. 4) is secured to the exterior surface of lower end wall 42 of tubular member 40 by means of a plurality of blind bolt assemblies 48. End wall 42 is provided with an axially located through bore 50 and apparatus cover 34 is also provided with a through bore 52 which is aligned with bore 50. An upwardly extensible piston 54 is operatively disposed within cylinder 46 in a conventional manner, and the upper end of piston 54 has fixedly secured thereon an upwardly extending spike or sensing pole 56. The uppermost end 58 of pole 56 is tapered so as to form a pointed end, and in this manner, when hydraulic power is supplied to cylinder 46 in a suitable manner and by means of suitable hydraulic circuitry, not shown, piston 54, along with spike 56, will be actuated upwardly so as to project spiked end 58 into the mine roof 20. It is, of course, to be noted that the external diameters of piston 54 and pole 56 are somewhat smaller than the diameters of bores 50 and 52 of end wall 42 and cover 34 in order to permit the former to pass freely through the latter.

An essentially triangular plate 60 is integrally secured to an external peripheral portion of tubular member 40 at the lowermost end thereof. The plate is disposed within a horizontal plane and is provided with a vertically extending through bore 62 formed essentially within the projecting apex portion thereof. A housing 64, having a substantially rectangular parallelepiped configuration, is secured to a side wall 66 of apparatus 12 by means of suitable fasteners which pass through vertically extending flanged members 68 integrally formed on opposite sides of housing 64. The housing 64 is provided with electrical circuitry (FIGS. 4 and 5), and a vertically extending pin type member 70 such as, for example, a 360° rotational toggle member, which projects upwardly through the upper wall 72 of housing 64.

Housing 64 is mounted on wall 66 of apparatus 12 within the vicinity of horizontally extending plate 60, and the length of the toggle 70 is such as to project upwardly through bore 62 of plate 60. The diametrical extent of bore 62 is somewhat greater than that of toggle 70, and in this manner, toggle 70 is able to be easily accomodated within plate 60. Toggle 70 is operatively associated with a normally open (N.O.) switch 79 (FIG. 5) disposed within housing 64, and such circuitry is, in turn, electrically connected to a suitable alarm system schematically illustrated at 74, and to a halt control schematically illustrated at 75. Halt control 75 (see FIG. 5) represents a conventional drop-out relay that connects a heavy duty load, such as the motive system operating a roof bolter, to a source of power when the relay system is energized, but disconnects the load when the relay system is de-energized.

Figure 5:
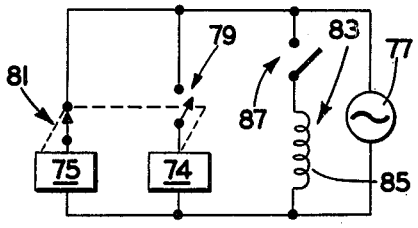
FIG. 5 is a schematic diagram of the alarm and control circuitry.

As shown in FIG. 5, alarm system 74 is connected to a voltage source 77 through a normally open (N.O.) set of contacts 79. Halt control 75 is connected to source 77 through a normally closed set of contacts 81. Both contacts 79 and contacts 81 are controlled by a relay coil 85 connected to source 77 through switch 87. Switch 87 is incorporated in housing 64 and is closed in response to pivoting of the toggle 70. It is thus apparent that pivoting of toggle 70, caused by shifting of the mine roof 20 relative to bolting mechanism 22 causes switch 87 to close, permitting relay coil 85 to be energized by voltage source 77. In response to energization of coil 85, contacts 79 close, thereby energizing alarm system 74 and contacts 81 open, removing power from halt control 75, thereby halting apparatus 12.

In utilizing the apparatus of the present invention, when the roof bolting apparatus 12, with its roof bolting mechanism 22, has been secured at a predetermined position within the mine and relative to the mine roof 20 and floor 14 by means of skid 16 and the jack pads 18, hydraulic cylinder 46 is actuated so as to project the piston 54 and sensing pole 56 upwardly. Spiked end 58 is thus embedded within the mine roof 20, and the position of the bolting apparatus 12 relative to the mine roof and floor is now fixed for sensing purposes.

Consequently, during the performance of the mine roof bolting operation by means of mechanism 22, should the apparatus 12 tend to lineally shift, rotate or tilt in any direction or angular mode so as to deleteriously affect the mechanism 22 and/or the apparatus 12, then biasing forces will be developed between the upper wall or cover 34 of apparatus 12 and the upper portion of piston 54. The wall of cover 34 which defines bore 52 will serve as a fulcrum about which the piston assembly 54–56 will be biased to pivot. As a result of this tendency to pivot, and the resulting limited pivotal movement of assembly 54–56, the lower portion of tubular member 40 will also experience some lineal displacement in view of the structural interaction between the lowermost end of piston 54 and end wall 42, particularly that portion of wall 42 which defines bore 50, and the loose mounting at bracket 30.

In light of this displacement of end wall 42, plate 60 is similarly moved so as to likewise bias toggle 70. Toggle 70 activates its associated switching mechanism, not shown, which, in turn, activates the alarm system 74 and halt control 75. Activation of control 74 automatically halts operation of bolter apparatus 12. Optionally, the halt control 75 may be omitted whereby only alarm system 74 is operative. The alarm system 74 may, of course, have incorporated therein any suitable type of alarm mechanism, the same being either an audible buzzer or bell, a blinking light or the like. Consequently, when the same is activated, mine personnel will be made aware of the fact that the apparatus 12 has indeed shifted and therefore, corrective measures taken.

In this disclosure there has been shown and described only the preferred embodiment of the invention, but, as aforementioned, the invention is capable of other and different embodiments and uses in other environments, all without departing from the inventive concept as expressed herein.

For example, it is apparent that housing 64 may be provided with pneumatic elements rather than electrical circuitry whereby alarm system 74 is pneumatically activated by toggle 70. Indeed, the alarm system itself may be energized by by a pneumatic source, whereby mechanism 10 is operated independently of any electrical source of power.

What is claimed is:

1. In combination with a mine roof bolting apparatus, a sensing mechanism comprising:

means secured to said roof bolting apparatus and operatively engaged with the roof of a mine for sensing any shift of said roof bolting apparatus with respect to said mine roof, in any direction within a horizontal plane, said means having a vertically movable probe assembly for embedding and fixing the sensing mechanism in a fixed position with respect to the mine roof, said means including means actuated by the pivotal movement of the probe assembly for generating a signal indicative of said shift.

2. In combination with a mine roof bolting apparatus, a sensing mechanism comprising:

means secured to said roof bolting apparatus an operatively engaged with the roof of a mine for sensing any shift of said roof bolting apparatus with respect to said mine roof, in any direction within a horizontal plane, said means including means for generating a signal indicative of said shift;

means embedded within said mine roof for establishing the relative fixed position of said apparatus with respect to said mine roof for said sensing function; and means for embedding said embedded means within said mine roof comprising an hydraulic cylinder means operatively connected to said embedded means and mounted upon said roof bolting apparatus.

3. The sensing mechanism as claimed in claim 2, further comprising means pivotably mounting said hydraulic cylinder means within said roof bolting apparatus.

4. The sensing mechanism as claimed in claim 1, wherein said sensing means comprises a 360° rotational toggle switch device.

5. The sensing mechanism as claimed in claim 1, wherein said signal is supplied to an alarm device.

6. The sensing mechanism as claimed in claim 5, wherein said alarm device is of the audible type.

7. The sensing mechanism as claimed in claim 5, wherein said alarm device is of the visual type.

8. In combination with a mine roof bolting apparatus, a sensing mechanism comprising:

means secured to said roof bolting apparatus and operatively engaged with the roof of a mine for sensing any shift of said roof bolting apparatus with respect to said mine roof, in any direction within a horizontal plane, said means including means for generating a signal indicative of said shift;

said sensing means also comprising a spiked probe adapted to be embedded within said mine roof for establishing the relative fixed position of said apparatus with respect to said mine roof for said sensing function;

hydraulic cylinder means operatively connected to said spiked probe for embedding said probe within said roof;

a 360° rotational toggle switch device operatively connected to said hydraulic cylinder means;

means pivotably mounting said hydraulic cylinder means and said spiked probe within said roof bolting apparatus; and alarm means operatively connected to said switch device for indicating any shift of said roof bolting apparatus as sensed by said switch device in response to pivotable movement of said cylinder and said probe.

9. The sensing mechanism of claim 8, further including control means connected to said switch device for halting operation of said bolting apparatus in response to pivotable movement of said cylinder and said probe.

10. The sensing mechanism as claimed in claim 1, wherein said signal is supplied to a control means for halting operation of said bolting apparatus.

11. For use in combination with a mine roof bolting apparatus, a movement sensing mechanism comprising:

a frame;

said frame having means adapted for replaceably securing said frame to a mine roof bolting apparatus;

means coupled to, and extensible from, said frame for engaging a surface of a mine to establish a given fixed position on said frame relative to any such mine surface; and means coupled to said frame and to said surface engaging means responsive only to substantially horizontal displacements between said frame and said surface engaging means for causing a sensible signalling of such displacements.

* * * * *

UNITED STATES PATENT OFFICE

CERTIFICATE OF CORRECTION

Patent No. 4,097,854 Dated June 27, 1978

Inventor(s) Sigmund Black and James L. Finney

It is certified that error appears in the above-identified patent and that said Letters Patent are hereby corrected as shown below:

Column 8, line 6, change "on" to -- of -- .

Signed and Sealed this

*Second* Day of *January 1979*

[SEAL]

*Attest:*

RUTH C. MASON
*Attesting Officer*

DONALD W. BANNER
*Commissioner of Patents and Trademarks*